United States Patent [19]

Bruno

[11] Patent Number: 4,512,052

[45] Date of Patent: Apr. 23, 1985

[54] LAST WITH DEVICE FOR APERTURE ADJUSTMENT AS REQUIRED AND SHIELD ELEMENT FOR LAST ADAPTABILITY TO RIGHT AND LEFT SHOES

[76] Inventor: Caminiti Bruno, Via Stradella 4/A, Milan, Italy, 20129

[21] Appl. No.: 468,966

[22] Filed: Feb. 23, 1983

[30] Foreign Application Priority Data

Mar. 15, 1982 [IT] Italy ..... 21138/82[U]

[51] Int. Cl.[3] ..... A43D 5/00

[52] U.S. Cl. ..... 12/116.2; 12/116.6

[58] Field of Search ..... 12/116.8, 117.2, 115.8, 12/116.2, 116.4, 116.6, 134, 135 R, 135 A; 223/113

[56] References Cited

U.S. PATENT DOCUMENTS

| | | | |
|---|---|---|---|
| 1,491,135 | 4/1924 | DePaul et al. | 12/116.2 |
| 1,632,044 | 6/1927 | Schoshusen | 12/116.6 |
| 1,746,466 | 2/1930 | Galterio | 12/116.2 |
| 2,511,366 | 6/1950 | Muzinich | 12/116.2 |
| 3,206,780 | 9/1965 | Cox | 12/116.2 |
| 4,069,531 | 1/1978 | Streich | 12/116.2 |

*Primary Examiner*—Werner H. Schroeder
*Assistant Examiner*—Steven N. Meyers
*Attorney, Agent, or Firm*—Dennison, Meserole, Pollack & Scheiner

[57] ABSTRACT

A last or shoe tree of the type comprising a first half-last and a second half-last, a resilient element for retaining said two half-lasts at closed spaced relationship, and a mechanism for determining the aperture of the two half-lasts, the last or shoe tree being essentially characterized by providing a device including a plate connected at a first location to said first half-last and connectable to said second half-last at locations differently spaced apart from said first location, so as to cause upon operation of said mechanism, (a) the aperture of said two half-lasts only at the toes, (b) parallel aperture of the two half-lasts, and (c) aperture of the two half-lasts at the zone opposite to the toe.

5 Claims, 5 Drawing Figures

LAST WITH DEVICE FOR APERTURE ADJUSTMENT AS REQUIRED AND SHIELD ELEMENT FOR LAST ADAPTABILITY TO RIGHT AND LEFT SHOES

This patent for industrial utility model relates to a last or shoe tree having a device for aperture or opening adjustment as required and shield element for last adaptability to right and left shoes, the combination and configuration of the parts thereof conferring thereto particular usefulness characteristics.

As well known, conventional lasts or shoe trees comprise first and second half-lasts hinged at the opposite side to the toe and provided with a mechanism enabling the aperture or opening of the two half-lasts for exerting a widening pressure on the shoe.

Owing to fixed fulcrum hinging or pivoting, such conventional lasts allow for widening of the two half-lasts only at the toe area, and accordingly cannot be used for sole and/or neck widening.

Additionally, conventional lasts or shoe trees are of ambidexter type, that is usable for both right and left shoes, this involving of course an evident shoe deformation with all of the resulting drawbacks.

It is the object of the present invention to provide a last or shoe tree of such a structure as to enable the aperture or opening of the two half-lasts at the tee area, parallel opening of said half-lasts, and also the opening of the latter at the opposite zone to the toe.

It is a further object of the invention to provide a last or shoe tree provided with means for allowing the adaptability thereof both to right shoe and left shoe so as not to cause any deformation thereof.

These and still further objects of the invention will become apparent to those skilled in the art from the reading of the following description and claims.

A last or shoe tree according to the invention is shown by way of example in the figures of the accompanying drawings, in which.

Figure 1:
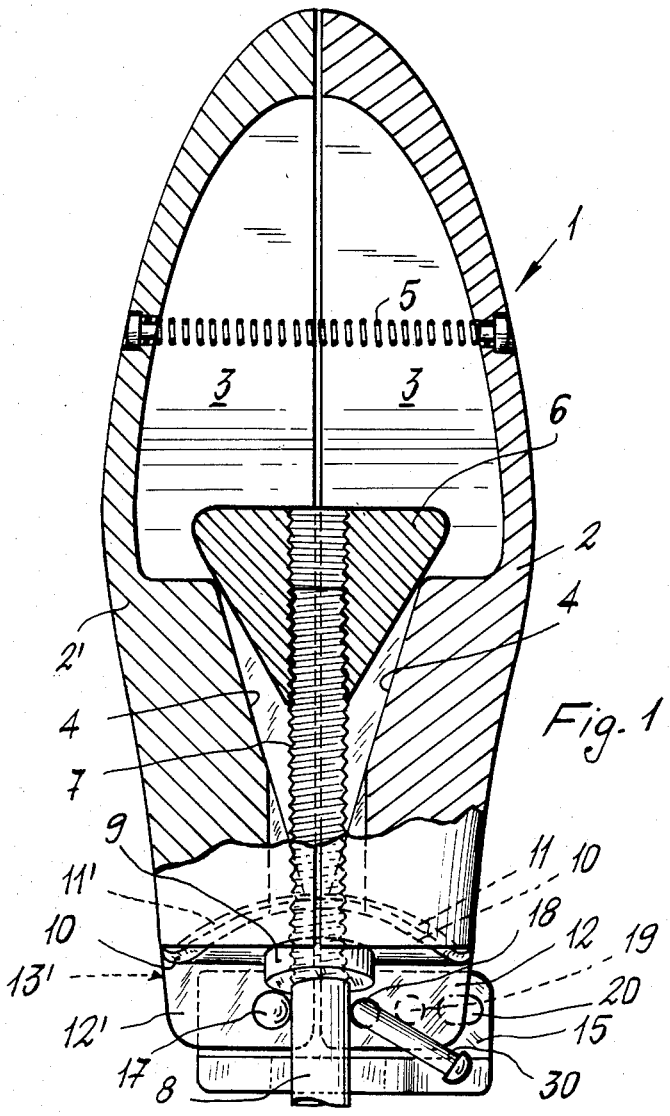
FIG. 1 is a view showing the front portion of a last or shoe tree, as partly separated or broken away, at completely closed position.

Referring to the above figures, a last or shoe tree generally denoted at 1 includes a front portion comprising two mirror-like elements 2, 2', each of which having an inner cavity 3 and a sloping surface 4. At said cavities 3 the two elements 2, 2' are interconnected by an extensible spring 5 arranged transversely of the axis of said last or shoe tree 1.

A wedge element 6 is controlled move along the sloping surfaces 4 by screwing thereof on a threaded portion 7 of a rod 8 provided with fixed washer 9 cooperating with a plate 10 bearing on the rear side 11 and 11' of said elements 2 and 2'.

Figure 2:
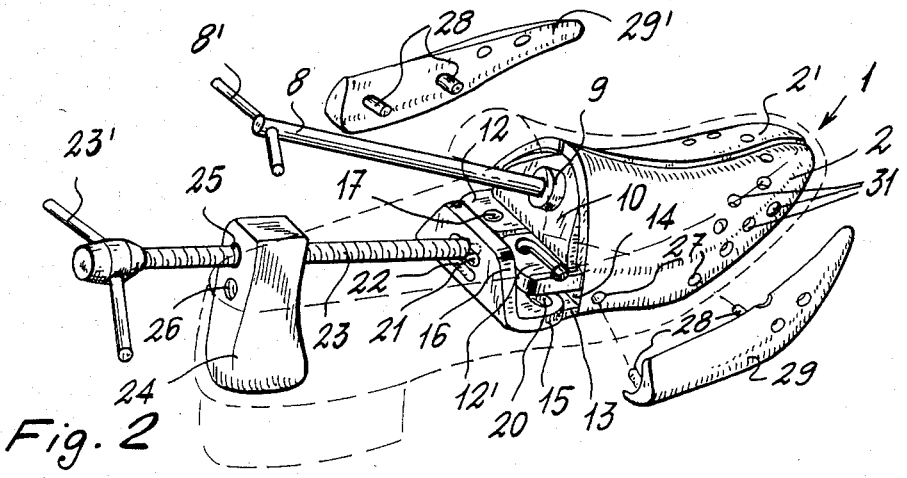
FIG. 2 is a view showing the last or shoe tree as a whole.

Each side 11 and 11' is provided with a projecting bracket 12, 12' each of which forming with an underlying spaced apart bracket 13, 13' (of which only bracket 13 is shown in FIG. 2) a slit 14 for accomodating a plate 15, provided with a bent over portion 16, and pivoted between brackets 12' and 13' with the aid of a pin 17. In addition to the passage hole for pin 17, said plate 15 has three further holes 18, 19 and 20, of which hole 20 is of extended development.

The bent over portion 16 of plate 15 also has two oblong holes for accomodating the end of a threaded rod 23 (FIG. 2), on which a heel-shaped element 24 can be screwed by inner threads of through holes 25 and 26 provided substantially transversely of said element 24.

The rods 8 and 23 are provided with an end portion 8' and 23' respectively, comprising the gripping member for rotation thereof.

Parts or elements 2 and 2' are provided with side holes 27 (FIG. 2) for the accomodation of small pins 28 integral with removable shaped shields 29, 29'. Shield 29 follows the pattern of a right shoe, while shield 29' follows the pattern of a left shoe.

The approach as proposed allows to adapt said last or shoe tree 1 both to right and left shoes by merely mounting shield 29 on element 2 in case of right shoe, or shield 29' on element 2' in case of left shoe, this resulting in the outstanding advantage of not deforming a shoe when being subjected to the expanding stress of elements 2 and 2', as occurs with conventional lasts or shoe trees.

Figure 3:
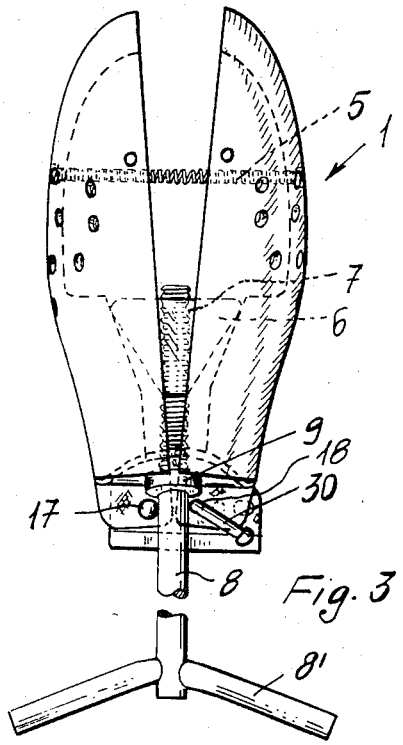
FIGS. 3, 4 and 5 are views of the last or shoe tree shown in FIG. 1 at three different opening positions.
Figure 4:
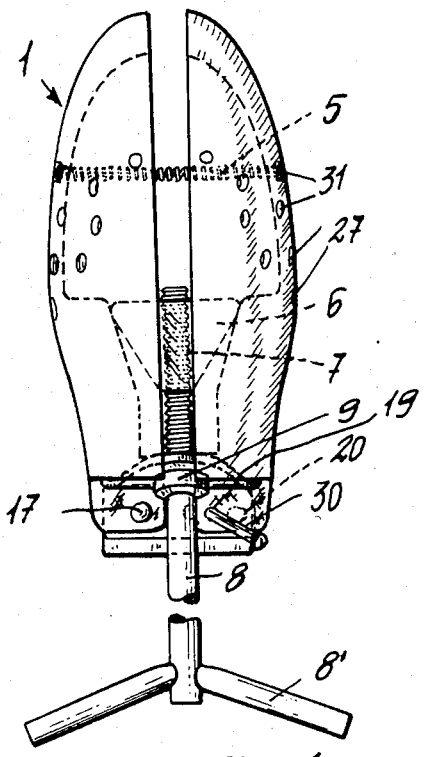
Figure 5:
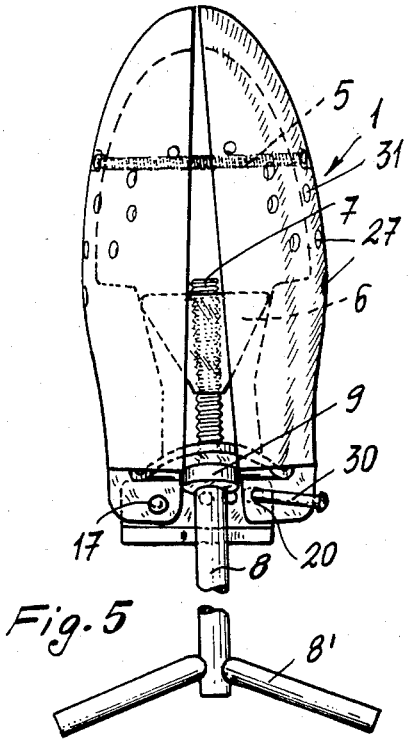

As shown in FIGS. 3, 4 and 5, by introducing a pin element 30 in bracket 12 to engage the hole 18 in plate 15, screwing of wedge element 6 along threaded portion 7 of rod 8 would cause the widening out of the toe only (FIG. 3). The engagement of pin element 30 with hole 19 in plate 15 enables the parallel opening of the two elements 2 and 2' (FIG. 4), and finally the engagement of pin element 30 with hole 20 in plate 15 enables the straddle or spreading out of elements 2 and 2' for better acting upon both the shoe sole and neck, and this in case by suitably adjusting the introduction of last or shoe tree 1 into the shoe and by interposing a possible shaped element (not shown) between said elements 2, 2' for widening out the neck only.

As shown in FIG. 2, the shaped element 24 is applied to the last or shoe tree 1 in order to cause the shoe elongation upon rotation of rod 23. This rod 23 cooperates with threaded holes 25 or 26 and holes 21 or 22 provided on the bent over portion 16 of plate 15 depending on whether a woman or man shoe is concerned.

Said last or shoe tree 1 is completed with holes 31 (FIG. 2) for application of conventional shaped elements to create slight deformations on the uppers at anatomic anomalies (such as corns, foot deformed fingers and the like).

What is claimed is:

1. A last for controlled stretching of shoes comprising a first half-last and a second half-last, said first and second half-lasts having forward toe portions and opposed rear portions, retaining means for resiliently retaining said half-lasts in closely spaced relation and for allowing lateral adjustment therebetween, and adjustment means for selective lateral adjustment of the two half-lasts relative to each other selectively and individually at at least said toe portions and said rear portions, said adjustment means comprising last manipulation means engaged between said half-lasts and selectively manipulable for a selective movement of said half-lasts relative to each other, said adjustment means further comprising connector means, said connector means extending between said half-lasts and including pivot means for pivotally engaging said half-lasts for enabling pivotal movement of said half-lasts relative to each other about fixed preselected points in response to manipulation of said manipulation means, and means for selectively varying the pivot means for changing said fixed preselected points whereby said adjustment means selectively provides for separate lateral adjustment of said two half-lasts at the toe portions, generally parallel to each other, and at the rear portions.

2. A last according to claim 1 wherein said connector means comprises a plate spanning said rear portions, said pivot means comprising a first pivot engaged between said first half-last and said plate for pivotally mounting said first half-last to said plate, and a second pivot engaged between said second half-last and said plate for pivotally mounting said second half-last to said plate, said means for selectively varying the pivot means comprising means on said plate selectively positioning said second pivot at fixed spaced points thereon.

3. A last according to claim 2 wherein said first half-last includes first bracket means overlying said plate, said first pivot comprising a first pivot pin and aligned apertures on said plate and said first bracket means receiving said first pivot pin, said second half-last including second bracket means overlying said plate, said second pivot comprising a second pivot pin, an aperture in said second bracket means receiving said second pivot pin, and a plurality of spaced apertures in said plate selectively aligned with said aperture in said second bracket means and receiving said second pivot pin, said plurality of spaced apertures comprising said means on said plate selectively positioning said second pivot.

4. A last according to claim 3 including shaped shield elements and means for selectively and removably mounting said shield elements to said first and second half-lasts for modification of the configuration thereof.

5. A last according to claim 4 including a heel element rearward of said half-lasts, and adjustable rod means engaged between said plate and said heel element for a selective varying of the distance therebetween.

* * * * *